US007699080B2

(12) United States Patent
Burgmeier et al.

(10) Patent No.: US 7,699,080 B2
(45) Date of Patent: Apr. 20, 2010

(54) APPARATUS FOR DISTRIBUTING A MEDIUM TO CONTAINERS

(75) Inventors: Berthold Burgmeier, Dischingen/Eglingen (DE); Manfred Schmid, Aufhausen (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/202,495

(22) Filed: Sep. 2, 2008

(65) Prior Publication Data

US 2009/0056828 A1 Mar. 5, 2009

(30) Foreign Application Priority Data

Sep. 1, 2007 (DE) ..... 10 2007 041 685

(51) Int. Cl.
*B65B 3/04* (2006.01)
*B65B 55/04* (2006.01)

(52) U.S. Cl. ..... 141/92; 141/236; 141/244; 422/302

(58) Field of Classification Search ..... 141/91–92, 141/234, 236–238, 242–244, 392; 422/302
See application file for complete search history.

(56) References Cited

U.S. PATENT DOCUMENTS 1,804,985 A 5/1931 Hoffman
2,855,738 A * 10/1958 Laxo et al. ..... 422/302
3,795,483 A 3/1974 Grafingholt
3,951,186 A * 4/1976 Mencacci ..... 141/5
4,848,419 A * 7/1989 Damen ..... 141/61
5,183,644 A * 2/1993 Martensson et al. ..... 141/92
2003/0116222 A1 * 6/2003 Spatafora ..... 141/237

FOREIGN PATENT DOCUMENTS

DE 29620323 U1 3/1997
DE 20120014 U1 3/2003
WO 2004033300 A1 4/2004

* cited by examiner

*Primary Examiner*—Gregory L Huson
*Assistant Examiner*—Nicolas A Arnett
(74) *Attorney, Agent, or Firm*—Rissman Hendricks & Oliverio, LLP

(57) ABSTRACT

An apparatus for distributing a medium to containers may include a distribution chamber which is arranged with respect to a rotation axis and which has a plurality of openings through which the medium can be guided out of the distribution chamber. A sleeve may be arranged on the distribution chamber, wherein the sleeve extends in the direction of the rotation axis of the distribution chamber. According to the invention, the apparatus has a supply tube for supplying the medium to the distribution chamber. Furthermore, the supply tube extends at least partially in the direction of the rotation axis of the distribution chamber, and the sleeve is designed such that it can rotate with respect to the supply tube. A gap through which the medium can pass is formed between the sleeve and the supply tube and extends in a circumferential direction around the rotation axis.

20 Claims, 2 Drawing Sheets

APPARATUS FOR DISTRIBUTING A MEDIUM TO CONTAINERS

CROSS-REFERENCE TO RELATED APPLICATION

This application claims the benefit of priority of German Patent Application No. 10 2007 041 685.9, filed Sep. 1, 2007, pursuant to 35 U.S.C. 119(a)-(d), the disclosure of which is incorporated herein by reference in its entirety as if fully set forth herein.

TECHNICAL FIELD

The present disclosure relates to an apparatus for distributing a medium to containers.

BACKGROUND

In the beverage-producing industry, it is customary to sterilise in particular plastic containers prior to filling. For this, the container which is subsequently to be filled will be filled with various, in particular gaseous, substances, such as e.g. hydrogen peroxide gas ($H_2O_2$), sterile air, hot air or cold air.

For the purpose of this filling operation, use is usually made of filling carousels on which a plurality of filling devices are arranged, which filling devices are in turn supplied by a central source. Particularly in the case of apparatuses for sterilising by means of $H_2O_2$, meticulous sealing must be ensured since these gases may also be harmful to humans.

In addition, care should be taken to ensure that most of the gas supplied to the apparatus actually also reaches the containers.

It may therefore be desirable to provide an apparatus for distributing a medium to containers, which exhibits low losses in terms of the medium which fills the containers.

SUMMARY OF THE INVENTION

An apparatus for distributing a medium to containers comprises a distribution chamber which is arranged such that it can rotate with respect to a rotation axis and which has a plurality of openings through which the medium can be guided out of the distribution chamber. Also provided is a sleeve which is arranged on the distribution chamber, wherein the sleeve extends in the direction of the rotation axis of the distribution chamber. According to the invention, the apparatus has a supply tube for supplying the medium to the distribution chamber, wherein the supply tube extends at least partially in the direction of the rotation axis of the distribution chamber. The sleeve here is designed such that it can rotate with respect to the supply tube, wherein a gap which extends in the circumferential direction around the rotation axis and through which the medium can pass is formed between the sleeve and the supply tube.

A distribution chamber is understood in particular to mean a cavity which is at least partially surrounded by a wall and into which the medium can pass, and from which the latter can also exit again through the openings and finally reach the containers.

The medium is in particular, but not exclusively, a gaseous medium, such as e.g. sterile air, hydrogen peroxide gas and the like.

The sleeve here is arranged in particular in a rotationally fixed manner on the distribution chamber, and particularly preferably is formed in one piece with the latter.

The medium is supplied to the distribution chamber via the supply tube, and the supply tube runs either inside or outside the sleeve and preferably inside the sleeve.

The medium can escape from the apparatus in a precisely defined manner via the gap which is formed between the sleeve and the supply tube. This gap thus also provides at the same time a precisely defined sealing effect, which allows a defined escape of gas.

In one preferred embodiment, the gap extends in the direction of the rotation axis, and with particular preference at least the narrowest region of this gap extends in the direction of the rotation axis. In a further advantageous embodiment, the gap has, in a radial direction with respect to the rotation axis, a width which is between about 0.1 mm and about 1.0 mm, preferably between about 0.2 mm and about 0.8 mm and particularly preferably between about 0.2 mm and about 0.4 mm. Based on complicated tests, the preferred width has been determined both theoretically and experimentally to be particularly suitable for achieving a precisely defined escape of hydrogen peroxide gas or other gases from the apparatus. In a further preferred embodiment, the supply tube is arranged radially inside the sleeve. This means that the gap is located inside the sleeve but outside the supply tube.

Preferably, the apparatus has an outer sleeve which is mounted by means of at least one bearing device such that it can rotate with respect to the sleeve. Preferably at least two bearing devices are provided, which bear the sleeve such that it can rotate with respect to the outer sleeve. Preferably, therefore, the outer sleeve is arranged together and in a rotationally fixed manner with the sleeve, and the sleeve is located between the outer sleeve and the supply tube. In this case, the bearings are particularly preferably designed as bearings which also withstand loads in the direction of the rotation axis. However, it would also be possible to provide a corresponding bearing device on the supply tube and to arrange the gap between two bearing devices, for example, between two rolling bearings.

In a further advantageous embodiment, the distribution chamber has a larger cross section than the sleeve. More specifically, the distribution chamber preferably also has a larger cross section than the outer sleeve. In one particularly preferred embodiment, the distribution chamber has a frustoconical portion which widens in the shape of the frustum of a cone, and an adjoining cylindrical portion in which the distribution chamber has a cross section that is constant but larger than the internal cross section of the outer sleeve. With particular preference, the distribution chamber also has a circular cross section.

In a further preferred embodiment, a plurality of openings are arranged in the circumferential wall of the distribution chamber. These openings may be adjoined, for example, by feed lines, which in turn open into nozzles which fill the containers.

In a further advantageous embodiment, a valve body is provided inside the distribution chamber and is arranged such that it can rotate with respect to the distribution chamber. Preferably, the valve body is arranged in a stationary manner and the distribution chamber rotates with respect to the valve body. Within the context of installations for disinfecting containers, a plurality of apparatuses of the abovementioned type are arranged next to one another, with these being connected to one another in each case via transport star wheels. In this case, on account of the system, there is often a region in which no containers are guided at any point in time. By means of this valve body, those openings which are located within this region can always be closed. Furthermore, there is no need for switchable valves when using this valve body.

Preferably, therefore, the valve body always at least partially covers a plurality of openings, regardless of its rotational position in the valve chamber. This reduces the proportion of escaping gas that is unused.

Preferably, the valve body covers approximately one-quarter of the abovementioned openings and, therefore, the valve body extends approximately over one-quarter revolution in the interior of the valve chamber.

In a further advantageous embodiment, the valve body has a substantially flat base surface. This flat base surface means that likewise a defined gap can be formed between the valve body and a base portion of the valve chamber, through which the gas likewise escapes only in a defined manner.

Preferably, the valve body has only smooth and flat surfaces. Preferably, the valve body is arranged on the supply tube.

In a further advantageous embodiment, the distribution chamber has a base surface, and a raised area which points in the direction of the supply tube is provided in the centre of this base surface. Said raised area is preferably a peak, and a curved surface is provided around this peak. This central region thus serves to guide the gas flow fed in from the supply tube in the direction of the openings.

The present invention also relates to an arrangement for distributing a medium to containers, comprising at least one apparatus of the type described above and also a plurality of connecting lines which guide the medium from the apparatus to the containers. Here, the apparatus according to the invention is preferably arranged on a distribution carousel, which distributes the medium to the individual containers.

Further advantages and embodiments arise from the enclosed drawings.

DETAILED DESCRIPTION

Figure 1:
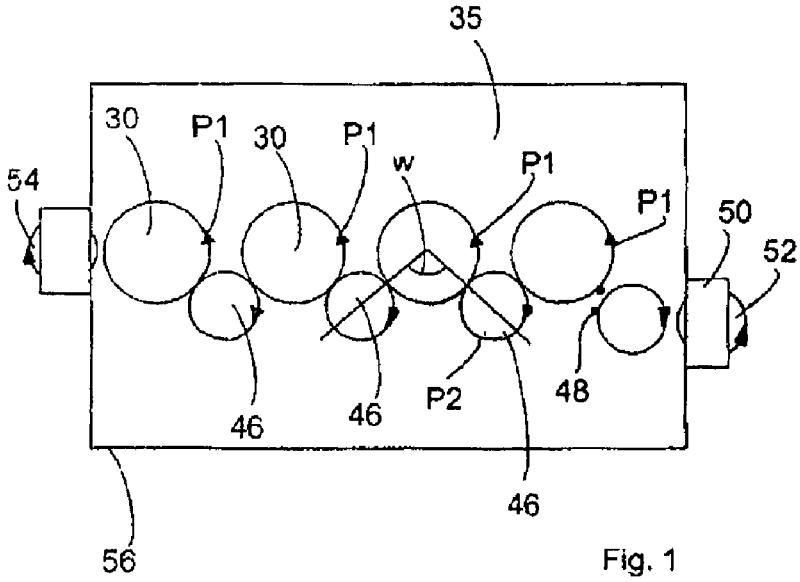
FIG. 1 shows a schematic view of arrangements according to the disclosure for distributing a medium.

FIG. 1 shows a schematic view of a plurality of arrangements 30 according to the invention for distributing a medium. Here, reference 35 denotes in its entirety an installation for treating containers, in particular for disinfecting containers. This arrangement comprises a closed housing 56, in the interior of which a plurality of arrangements 30 for distributing the medium are arranged. The individual arrangements 30 comprise carousels which, as indicated by the arrows P1, rotate in the counterclockwise direction. Provided in each case between these individual arrangements are transfer star wheels 46 which transfer the containers 48 (shown only schematically) to the respective next arrangement 30. The containers are transported into the arrangement 35 via a feed device 50 and a transfer carousel 52 arranged there. The containers passing out of the arrangement 35 are transported away via a discharge carousel 54. By virtue of the housing 56, the user is protected against any escape of harmful gases, such as hydrogen peroxide gases for example. The transfer star wheels 46 rotate in the clockwise direction, as indicated by the arrow P2.

As explained, the containers are in each case guided in the direction of the arrows P1 and P2. In each arrangement 30, therefore, there is an angle range within which no containers are guided, said angle range being denoted by reference W.

Figure 2:
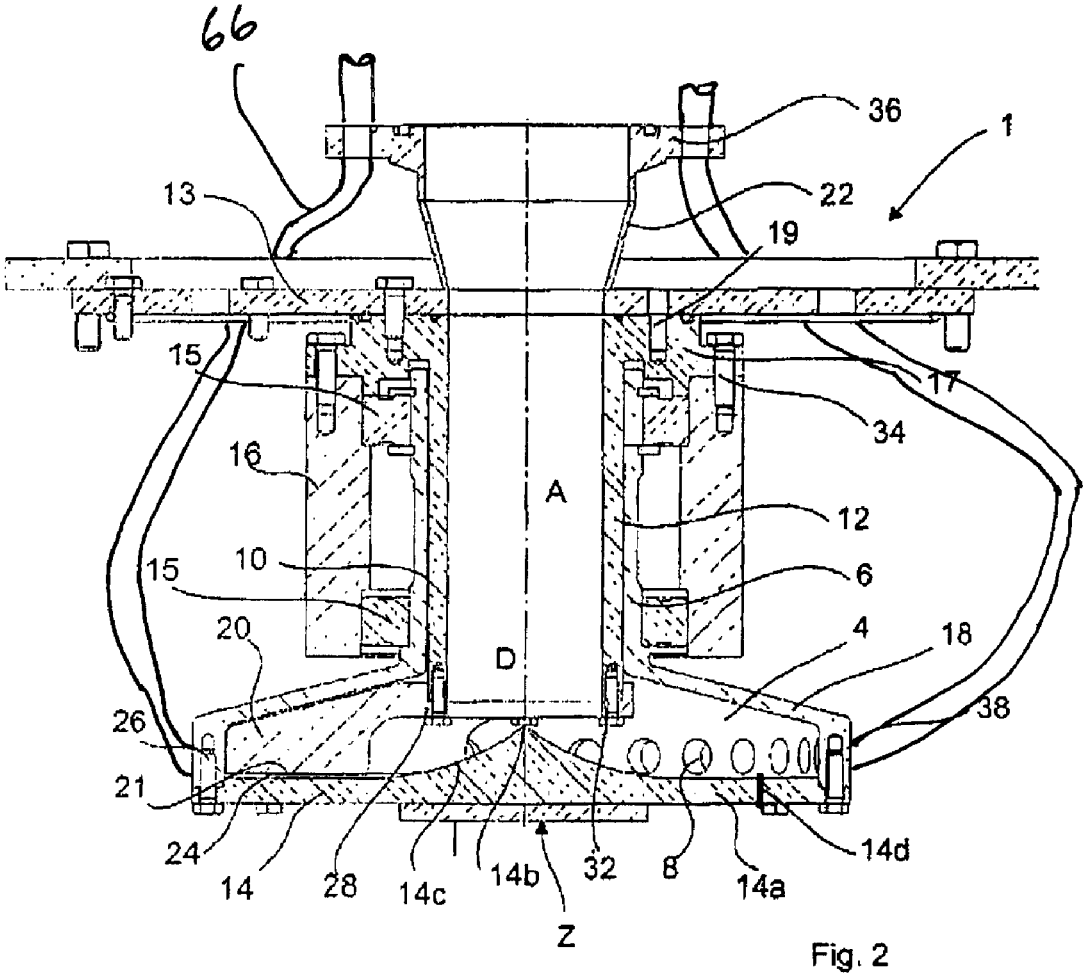
FIG. 2 shows a detailed view of an apparatus according to the disclosure for distributing media.

FIG. 2 shows an apparatus 1 according to the invention for distributing a medium. This apparatus 1 comprises a distribution chamber 4, via which the medium A passing through a supply tube 12 into the distribution chamber 4 is distributed in the direction of a plurality of openings 8. These openings 8 are arranged here in a circumferential wall 38 of the distribution chamber 4.

The distribution chamber 4 has a base 14 which is screwed onto an upper part 18 of the distribution chamber 4 by means of screw connections 26. This upper part 18 has a cross section which widens conically from top to bottom.

The base 14 has in its centre Z a raised area, more specifically a peak 14*b*, which points upwards, i.e. in the direction of the supply tube 12.

This peak 14*b* is adjoined by a curved region 14*c*, and this curved region 14*c* is adjoined by a rectilinear portion 14*a* of the base 14. These individual portions serve to guide the medium A in the direction of the openings 8.

In the rectilinear portion 14*a* of the base, there is a discharge opening 14*d* (shown only schematically) which serves for discharging condensate from the distribution chamber. This drainage opening 14*d* preferably has a diameter of approx. 5 mm.

A sleeve 6 is arranged on the distribution chamber 4. This sleeve 6 in turn extends in the direction of the rotation axis D, around which the distribution chamber 4 is arranged such that it can rotate together with the sleeve 6. The abovementioned supply tube 12 runs inside the sleeve 6. The supply tube 12 is arranged with respect to the sleeve 6 in such a way that a gap 10 is formed between the supply tube 12 and the sleeve 6, via which gap the medium A, for example hydrogen peroxide gas ($H_2O_2$) can pass in a defined manner upwards and ultimately to the outside.

Starting from the gap 10, the medium is deflected and, after passing the two bearing devices 15, passes back down again and out of the apparatus 1.

A defined pressure loss of the apparatus 1 as a whole thus takes place via this gap 10. The sleeve 12 is arranged such that it can rotate with respect to an outer sleeve 16, by means of two bearing devices 15 which are for example rolling bearings. The outer sleeve 16 is in turn arranged in a stationary and rotationally fixed manner. Here, the rolling bearings 15 are rolling bearings which can also absorb loads in the axial direction, i.e. along the rotation axis D. Preferably, these are hybrid bearings comprising ceramic rolling elements or balls. The flow cross section of the medium passing through the gap 10 is much smaller than the flow cross section formed by the internal cross section of the supply tube 12. These two flow cross sections are in a ratio of between about 1:10 and about 1:60, preferably between about 1:20 and about 1:40, and particularly preferably between about 1:30 and about 1:35. At the same time, therefore, this gap 10 also acts as a seal between the distribution chamber 4 and the areas located outside this distribution chamber 4.

The outer sleeve 16 is arranged on a support 17 by means of screw connections 34, with this support 17 in turn being arranged on a flange 13 by means of screw connections 19. The supply tube 12 is adjoined at the top by the further access tube 22, which widens in the upward direction and is in turn fixed to a flange 36.

Feed lines 66 for the medium A may be arranged on this flange 36. The openings 8 in the circumferential wall 38 of the distribution chamber 4 may be adjoined for example by the feed lines 66, which in turn open into nozzles that fill the containers.

A valve body 20 is provided inside the distribution chamber 4. During operation, this valve body 20 is stationary and the distribution chamber 4, or more specifically the circumferential wall 38 and the upper part 18, rotate with respect to this valve body. Always some of the openings 8 in the circumferential wall 38 are covered by this valve body 20. The distribution chamber 4 is therefore delimited by the base 14 and the upper part 18 with the circumferential wall 38.

The valve body 20 preferably has rectilinear surfaces, and in particular a rectilinear base portion 21. A further gap 24 is formed between the base portion 21 and the base 14 of the valve chamber 4, via which gap the medium can likewise escape outwards in a defined manner. This gap 24 prevents any friction losses from occurring between the base 14 and the valve body 20 during the rotation of the base 14. The gap 24 has a width of approx. 0.5 mm. The flow cross section permitted by each of the individual openings 8 is much larger than the flow cross section escaping outwards past the valve body 20 as a whole. The valve body 20, or more specifically a ring 28 of the valve body 20, is arranged on the supply tube 12 in a rotationally fixed manner by means of screw connections 32.

As mentioned above with reference to FIG. 1, in each arrangement 30 there are regions w in the circumferential direction in which containers are never arranged. The valve body 20 means that, in this region, always the openings located in this region are largely covered, regardless of the rotational position of the valve chamber 4. In this way, it is possible to prevent the medium from flowing out unused through the respective openings, even without using switchable valves.

Figure 3:
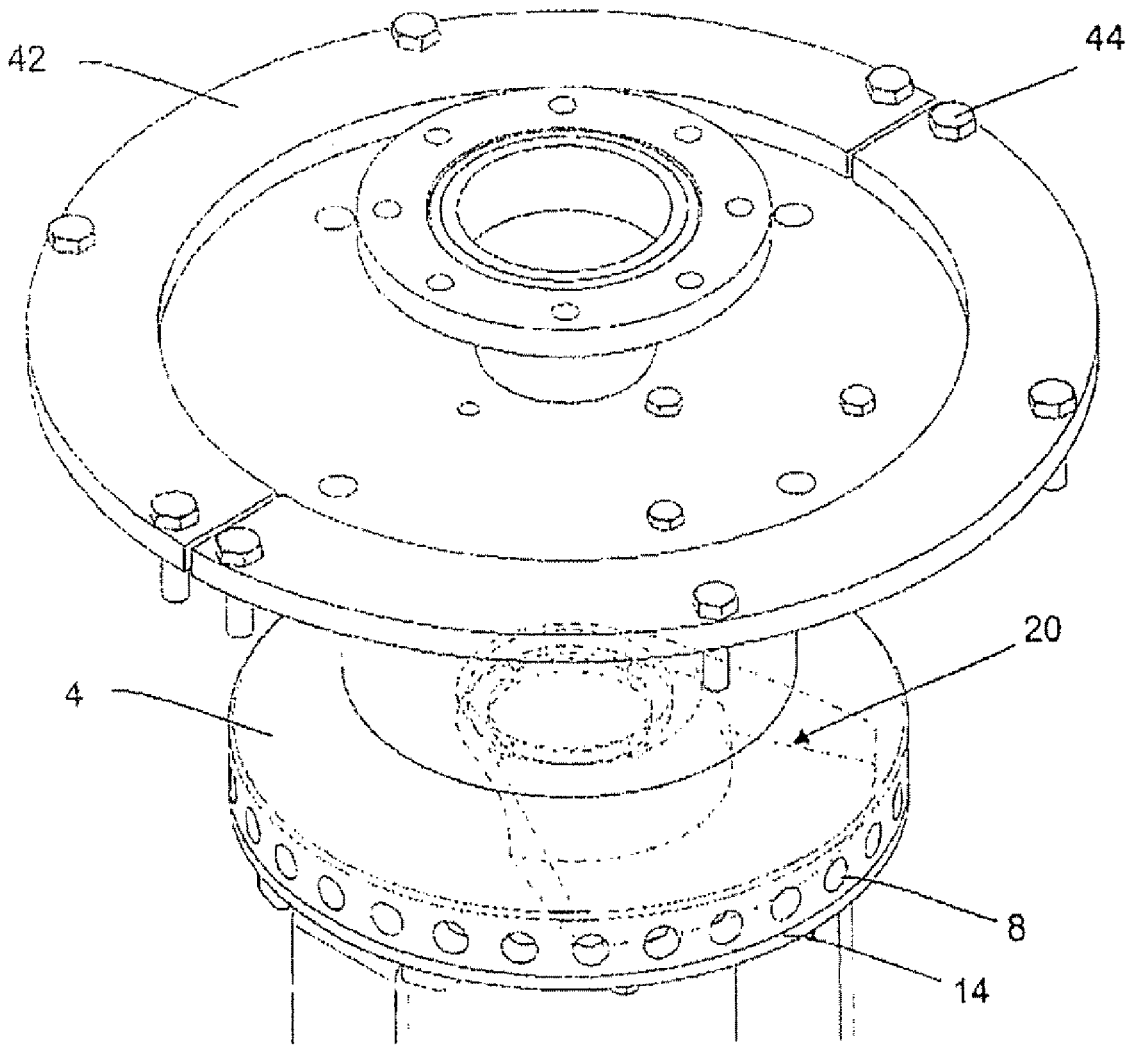
FIG. 3 shows an oblique view of the apparatus of FIG. 2.

FIG. 3 shows a further view of the apparatus of FIG. 2. It can be seen that the valve body 20 is flanged onto the supply tube 12 and extends in the circumferential direction over a predefined angle, for example 70°. Reference 42 denotes a two-part ring which in turn serves to fix the abovementioned flange 13 by means of screws 44.

The openings 8 have a diameter of between about 2 mm and about 10 mm, preferably between about 3 mm and about 9 mm and particularly preferably approximately 8 mm.

It will be apparent to those skilled in the art that various modifications and variations can be made to the apparatus for distributing a medium to containers of the present disclosure without departing from the scope of the invention. Other embodiments of the invention will be apparent to those skilled in the art from consideration of the specification and practice of the invention disclosed herein. It is intended that the specification and examples be considered as exemplary only.

What is claimed is:

1. Apparatus for distributing a medium to containers, comprising:

a distribution chamber rotatable with respect to a rotation axis and having a plurality of openings for guiding the medium out of the distribution chamber;

a sleeve arranged on the distribution chamber, the sleeve extending away from the distribution chamber in the direction of the rotation axis of the distribution chamber;

a supply tube configured to supply the medium to the distribution chamber, the supply tube extending at least partially in the direction of the rotation axis of the distribution chamber, the sleeve being rotatable with respect to the supply tube; and a gap between the sleeve and the supply tube, the gap extending in a circumferential direction around the rotation axis, the gap accommodating flow of the medium therethrough.

2. Apparatus according to claim 1, wherein the gap extends in the direction of the rotation axis.

3. Apparatus according to claim 1, wherein the gap has, in a radial direction with respect to the rotation axis, a width between about 0.1 mm and about 1.0 mm.

4. Apparatus according to claim 3, wherein the gap has, in a radial direction with respect to the rotation axis, a width between about 0.2 mm and about 0.8 mm.

5. Apparatus according to claim 4, wherein the gap has, in a radial direction with respect to the rotation axis, a width between about 0.2 mm and about 0.4 mm.

6. Apparatus according to claim 1, wherein the supply tube is arranged radially inside the sleeve.

7. Apparatus according to claim 1, further comprising an outer sleeve rotatably mounted with respect to the sleeve by means of at least one bearing device.

8. Apparatus according to claim 1, wherein the distribution chamber has a larger cross section than the sleeve.

9. Apparatus according to claim 1, wherein the plurality of openings are arranged in a circumferential wall of the distribution chamber.

10. Apparatus according to claim 1, wherein the distribution chamber comprises a base surface having a raised area, the raised area being at the center of the base surface and extending in the direction of the supply tube.

11. Arrangement for distributing a medium to containers, comprising:

an apparatus according to claim 1;

a plurality of connecting lines configured to guide the medium from the apparatus to the containers.

12. Apparatus for distributing a medium to containers, comprising:

a distribution chamber rotatable with respect to a rotation axis and having a plurality of openings for guiding the medium out of the distribution chamber;

a sleeve arranged on the distribution chamber, the sleeve extending in the direction of the rotation axis of the distribution chamber;

a supply tube configured to supply the medium to the distribution chamber, the supply tube extending at least partially in the direction of the rotation axis of the distribution chamber, the sleeve being rotatable with respect to the supply tube;

a gap between the sleeve and the supply tube, the gap extending in a circumferential direction around the rotation axis, the gap accommodating flow of the medium therethrough; and a valve body inside the distribution chamber, the valve body being rotatable with respect to the distribution chamber.

13. Apparatus according to claim 12, wherein the valve body is configured to at least partially cover a plurality of openings, regardless of the rotational position of the valve body in the distribution chamber.

14. Apparatus according to claim 12, wherein the valve body is associated with the supply tube.

15. Apparatus according to claim 12, wherein the valve body has a substantially flat base surface.

16. Apparatus for distributing a medium to containers, comprising:

a distribution chamber rotatable with respect to a rotation axis and having a plurality of openings for guiding the medium out of the distribution chamber, the distribution chamber including a base portion and a tapered upper portion;

a sleeve arranged on the distribution chamber, the sleeve extending from the tapered upper portion of the distribution chamber in the direction of the rotation axis of the distribution chamber;

a supply tube configured to supply the medium to the distribution chamber, the supply tube extending at least partially in the direction of the rotation axis of the distribution chamber, the sleeve being rotatable with respect to the supply tube; and a gap between the sleeve and the supply tube, the gap extending in a circumferential direction around the rotation axis, the gap accommodating flow of the medium therethrough.

17. Apparatus according to claim 16, wherein the gap extends in the direction of the rotation axis.

18. Apparatus according to claim 16, wherein the supply tube is arranged radially inside the sleeve.

19. Apparatus according to claim 16, further comprising an outer sleeve rotatably mounted with respect to the sleeve by means of at least one bearing device.

20. Apparatus according to claim 16, further comprising a valve body inside the distribution chamber, the valve body being rotatable with respect to the distribution chamber, the valve body being configured to at least partially cover a plurality of openings, regardless of the rotational position of the valve body in the distribution chamber.

* * * * *